US010638902B2

(12) United States Patent
Acker et al.

(10) Patent No.: US 10,638,902 B2
(45) Date of Patent: May 5, 2020

(54) VACUUM CLEANER

(71) Applicant: BISSELL Homecare, Inc., Grand Rapids, MI (US)

(72) Inventors: Matthew T. Acker, Grand Rapids, MI (US); Gabriel Melching, Grand Rapids, MI (US); Mark J. Bissell, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 154 days.

(21) Appl. No.: 15/850,513

(22) Filed: Dec. 21, 2017

(65) Prior Publication Data

US 2018/0177368 A1 Jun. 28, 2018

Related U.S. Application Data

(60) Provisional application No. 62/438,180, filed on Dec. 22, 2016.

(51) Int. Cl.

| | |
|---|---|
| ***A47L 9/10*** | (2006.01) |
| ***A47L 9/16*** | (2006.01) |
| ***A47L 5/22*** | (2006.01) |
| ***A47L 9/00*** | (2006.01) |
| ***A47L 5/28*** | (2006.01) |
| ***A47L 9/24*** | (2006.01) |
| ***A47L 5/36*** | (2006.01) |
| ***A47L 9/22*** | (2006.01) |

(52) U.S. Cl.

CPC ..... *A47L 9/1683* (2013.01); *A47L 5/225* (2013.01); *A47L 5/28* (2013.01); *A47L 5/36* (2013.01); *A47L 9/0072* (2013.01); *A47L 9/10* (2013.01); *A47L 9/106* (2013.01); *A47L 9/165* (2013.01); *A47L 9/1616* (2013.01); *A47L 9/1666* (2013.01); *A47L 9/22* (2013.01); *A47L 9/242* (2013.01); *A47L 9/244* (2013.01)

(58) Field of Classification Search

CPC ..... A47L 9/1683; A47L 5/225; A47L 5/28; A47L 5/36; A47L 9/0072; A47L 9/106; A47L 9/1616; A47L 9/165; A47L 9/1666; A47L 9/22; A47L 9/242; A47L 9/244

See application file for complete search history.

(56) References Cited

U.S. PATENT DOCUMENTS

| | | | |
|---|---|---|---|
| 2,230,453 | A | 2/1941 | Fitch |
| 5,248,323 | A | 9/1993 | Stevenson |
| 5,309,600 | A | 5/1994 | Pino |
| 5,524,321 | A | 6/1996 | Umbach |
| 5,593,479 | A | 1/1997 | Frey |
| 5,715,566 | A | 2/1998 | Umbach |

(Continued)

FOREIGN PATENT DOCUMENTS

| | | | |
|---|---|---|---|
| EP | 1842475 | A1 | 10/2007 |
| KR | 101262652 | B1 | 5/2013 |

(Continued)

*Primary Examiner* — Robert J Scruggs
(74) *Attorney, Agent, or Firm* — McGarry Bair PC

(57) ABSTRACT

A vacuum cleaner includes an air treatment or debris removable assembly with a multi-layer filtration stage. The multi-layer filtration stage can include an outer mesh screen, a louvered exhaust grill, and a multi-layer filter. Optionally, an inner perforated exhaust grill is also provided. The debris removable assembly can further include a cyclonic filtration stage.

21 Claims, 14 Drawing Sheets

(56) References Cited

U.S. PATENT DOCUMENTS

| | | | |
|---|---|---|---|
| 5,836,047 | A | 11/1998 | Choi |
| 5,922,093 | A | 7/1999 | James |
| 6,003,196 | A | 12/1999 | Stephens |
| 6,026,540 | A | 2/2000 | Cipolla |
| 6,070,291 | A | 6/2000 | Reindle |
| 6,090,184 | A | 7/2000 | Cartellone |
| 6,113,663 | A | 9/2000 | Liu |
| 6,260,234 | B1 | 7/2001 | Thur |
| 6,428,589 | B1 | 8/2002 | Younger |
| 6,488,744 | B2 | 12/2002 | Cartellone |
| 6,558,453 | B2 | 5/2003 | Sepke |
| 6,599,339 | B2 | 7/2003 | Oh |
| 6,648,934 | B2 | 11/2003 | Lee |
| 6,857,165 | B2 | 2/2005 | Oh |
| 6,913,635 | B2 | 7/2005 | Yoo |
| 6,951,045 | B2 | 10/2005 | Paliobeis |
| 7,105,034 | B2 | 9/2006 | Oh |
| RE39,473 | E | 1/2007 | Cipolla |
| 7,188,388 | B2 | 3/2007 | McDowell |
| 7,325,274 | B2 | 2/2008 | Jeong |
| 7,329,295 | B2 | 2/2008 | Greene |
| 7,331,084 | B2 | 2/2008 | Oh |
| 7,377,007 | B2 | 5/2008 | Best |
| 7,419,520 | B2 | 9/2008 | Lee |
| 7,547,340 | B2 | 6/2009 | Park |
| 7,559,965 | B2 | 7/2009 | Oh |
| 7,678,166 | B2 | 3/2010 | Han |
| 7,691,161 | B2 | 4/2010 | Oh |
| 7,722,693 | B2 | 5/2010 | Han |
| 7,862,637 | B2 | 1/2011 | Han |
| 8,182,563 | B2 | 5/2012 | Jupe |
| 8,409,335 | B2 | 4/2013 | Horne |
| 8,495,789 | B2 | 7/2013 | Nicolaou |
| 8,551,227 | B2 | 10/2013 | Horne |
| 8,572,789 | B2 | 11/2013 | Horne |
| 8,763,201 | B2 | 7/2014 | Kim |
| 9,005,325 | B2 | 4/2015 | Smith |
| 9,095,246 | B2 | 8/2015 | MacNaughton |
| 9,144,358 | B2 | 9/2015 | Smith |
| 2002/0011050 | A1 | 1/2002 | McDowell |
| 2002/0166199 | A1 | 11/2002 | Morrow |
| 2004/0098826 | A1 | 5/2004 | Joo |
| 2004/0163206 | A1 | 8/2004 | Oh |
| 2006/0042039 | A1* | 3/2006 | McDowell ..... A47L 5/362 15/353 |
| 2007/0175185 | A1* | 8/2007 | Kim ..... B01D 45/14 55/337 |
| 2008/0028940 | A1 | 2/2008 | Lee |
| 2009/0031525 | A1* | 2/2009 | Makarov ..... A47L 9/1625 15/347 |
| 2010/0242215 | A1* | 9/2010 | Dyson ..... A47L 5/362 15/347 |
| 2011/0303239 | A1* | 12/2011 | Harrison ..... A47L 5/30 134/6 |
| 2012/0047682 | A1 | 3/2012 | Rukavina |
| 2012/0167336 | A1 | 7/2012 | Tran |
| 2013/0232722 | A1 | 9/2013 | Conrad |
| 2014/0013537 | A1 | 1/2014 | Kasper |
| 2014/0053367 | A1 | 2/2014 | Conrad |
| 2014/0059800 | A1 | 3/2014 | Bassett |
| 2014/0082883 | A1 | 3/2014 | Tran |
| 2014/0109337 | A1* | 4/2014 | Krebs ..... A47L 9/1666 15/339 |
| 2014/0237765 | A1 | 8/2014 | Petersen |
| 2014/0237767 | A1* | 8/2014 | Conrad ..... A47L 9/2857 15/353 |
| 2015/0068169 | A1 | 3/2015 | Winter |
| 2015/0107449 | A1* | 4/2015 | Son ..... A47L 9/0072 95/2 |
| 2016/0037987 | A1 | 2/2016 | Morrow |
| 2016/0174803 | A1 | 6/2016 | Vines |
| 2016/0206169 | A1 | 7/2016 | Ahn |
| 2018/0333021 | A1* | 11/2018 | Bohlen ..... A47L 5/24 |

FOREIGN PATENT DOCUMENTS

| | | | |
|---|---|---|---|
| WO | 0234365 | A1 | 5/2002 |
| WO | 11009251 | A1 | 1/2011 |
| WO | 16099040 | A1 | 6/2016 |
| WO | 16114580 | A1 | 7/2016 |

* cited by examiner

VACUUM CLEANER

CROSS-REFERENCE TO RELATED APPLICATION(S)

This application claims the benefit of U.S. Provisional Patent Application No. 62/438,180, filed Dec. 22, 2016, which is incorporated herein by reference in its entirety.

BACKGROUND

Vacuum cleaners can be embodied as upright units or portable, hand-carriable units. In some instances, a vacuum cleaner can be reconfigurable between an upright cleaning mode and a lift-off mode in which a smaller pod or hand-carriable unit is removed from the vacuum cleaner for use in a cleaning operation.

BRIEF SUMMARY

A vacuum cleaner according to one embodiment of the invention includes a working air path with a dirty air inlet and a clean air outlet, a motor/fan assembly in fluid communication with the dirty air inlet for generating a working airstream through the working air path, and a debris removal assembly for removing and collecting debris from the working airstream for later disposal. The debris removal assembly has a central axis and includes a multi-layer filtration stage having a louvered exhaust grill comprising a plurality of louvers forming air flow openings therebetween, a mesh screen disposed radially outwardly from the louvers relative to the central axis, and a multi-layer filter mounted within the louvered exhaust grill, fluidly downstream of the air flow openings, and comprising multiple layers of filtration material.

DETAILED DESCRIPTION

The invention relates to vacuum cleaners. In one of its aspects, the invention relates to air treatment and debris removal assemblies for vacuum cleaners. In another aspect, the invention relates to an upright vacuum cleaner comprising a hand-carriable unit or a detachable pod unit.

Figure 1:
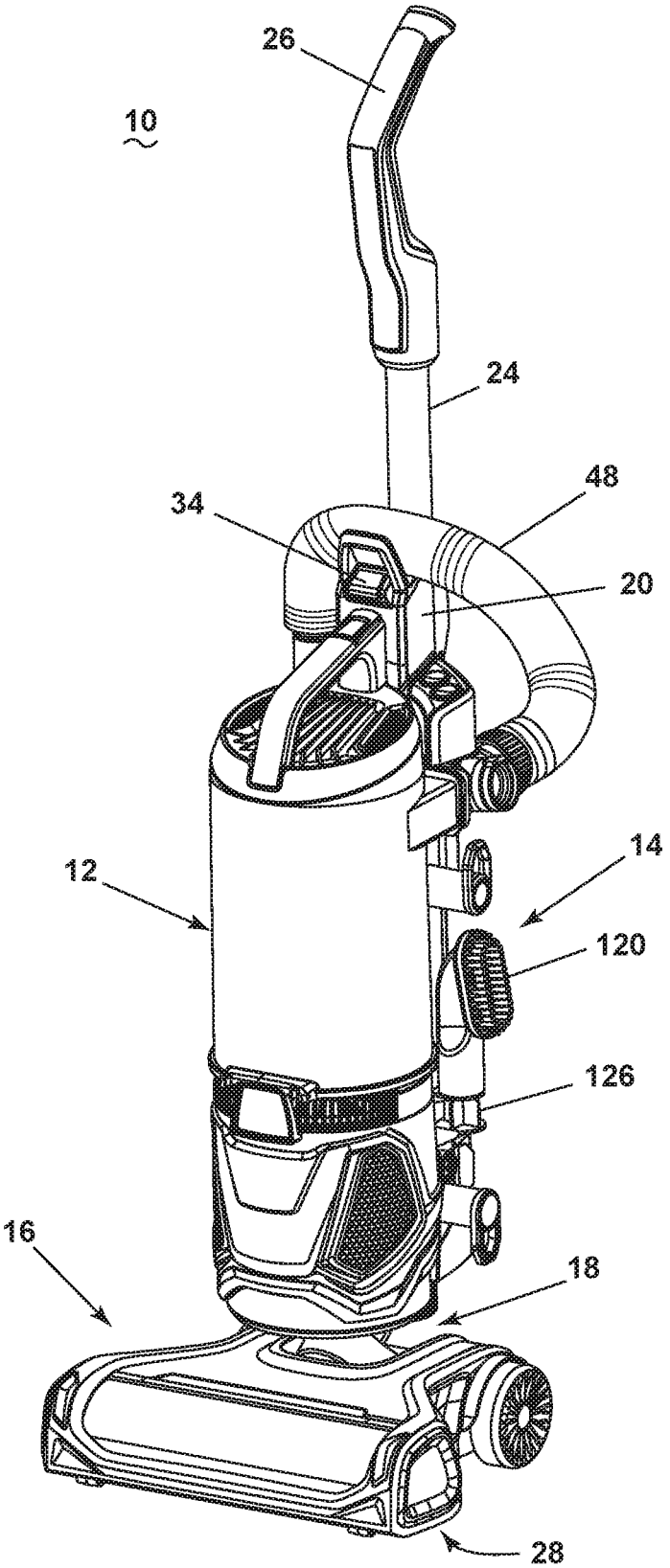
FIG. 1 is a perspective view of a vacuum cleaner according to one embodiment of the invention, with the vacuum cleaner in an upright mode of operation.

FIG. 1 is a perspective view of a vacuum cleaner 10 according to one embodiment of the invention, with the vacuum cleaner 10 in an upright mode of operation. As illustrated herein, the vacuum cleaner 10 is an upright vacuum cleaner having a detachable pod or hand-carriable unit 12. The vacuum cleaner 10 includes a housing that includes an upright body 14 that is pivotally connected to a floor cleaning head or base 16 for directing the base 16 across the surface to be cleaned. A pivot coupling 18 can connect the upright body 14 with the base 16. The pivot coupling 18 can be a single axis or multi-axis coupling.

Figure 2:
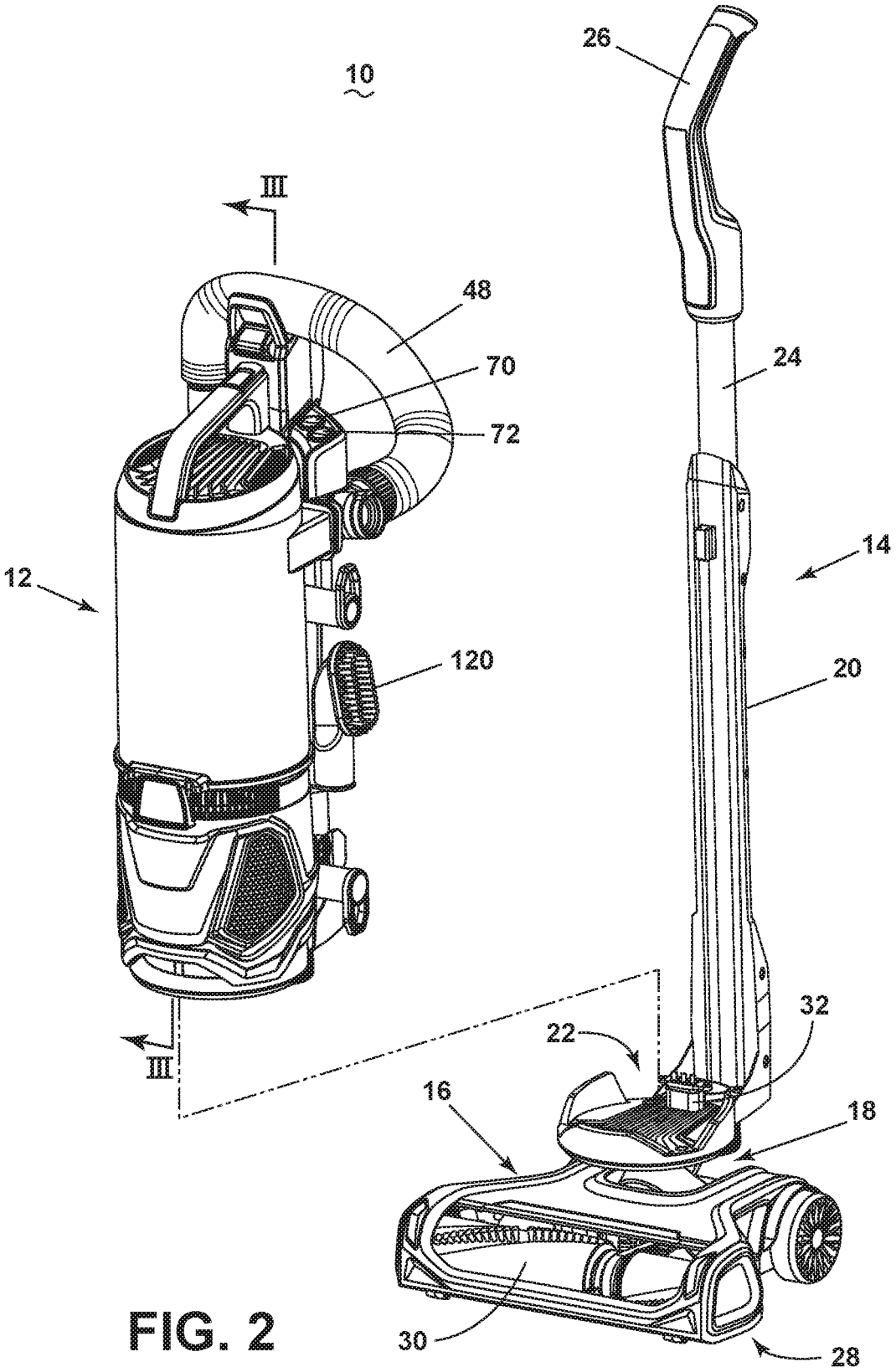
FIG. 2 is a partially exploded view of the vacuum cleaner from FIG. 1, where a pod is detached for use in a hand-carried mode of operation.

With additional reference to FIG. 2, the upright body 14 includes a main support section or frame 20 having a receiver 22 on a front side thereof and an elongated handle 24 extending upwardly from the frame 20 that is provided with a hand grip 26 at one end that can be used for maneuvering the vacuum cleaner 10 over a surface to be cleaned. The receiver 22 can receive and support the pod 12 on the upright body 14.

A suction nozzle 28 can be provided on the floor cleaning or base 16 adapted to move over the surface to be cleaned. An agitator 30 can be provided adjacent to the suction nozzle 28 for agitating the surface to be cleaned so that the debris is more easily ingested into the suction nozzle. A portion of the housing of the base 16 is cut away in FIG. 2 to show the agitator 30. Some examples of agitators 30 include, but are not limited to, a horizontally-rotating brushroll, dual horizontally-rotating brushrolls, one or more vertically-rotating brushrolls, or a stationary brush. A working air conduit 32 can extend though the base 16, from the suction nozzle 28 to the receiver 22, in order to place the pod 12 in fluid communication with the suction nozzle 28 when the pod 12 is secured on the upright body 14. The working air conduit 32 can extend at least partially through the pivot coupling 18, or can extend at least partially exteriorly of the pivot coupling 18.

FIG. 1 shows the vacuum cleaner 10 in an upright mode of operation in which the pod 12 is secured to the upright body 14. FIG. 2 is a partially exploded view of the vacuum cleaner 10 from FIG. 1, where a pod 12 is detached for use in a hand-carried mode of operation, also referred to herein as a pod mode or portable mode. A pod release button assembly 34 can be provided for selectively releasing a latch coupling the pod 12 to the upright body 14, and is described in more detail below.

Figure 3:
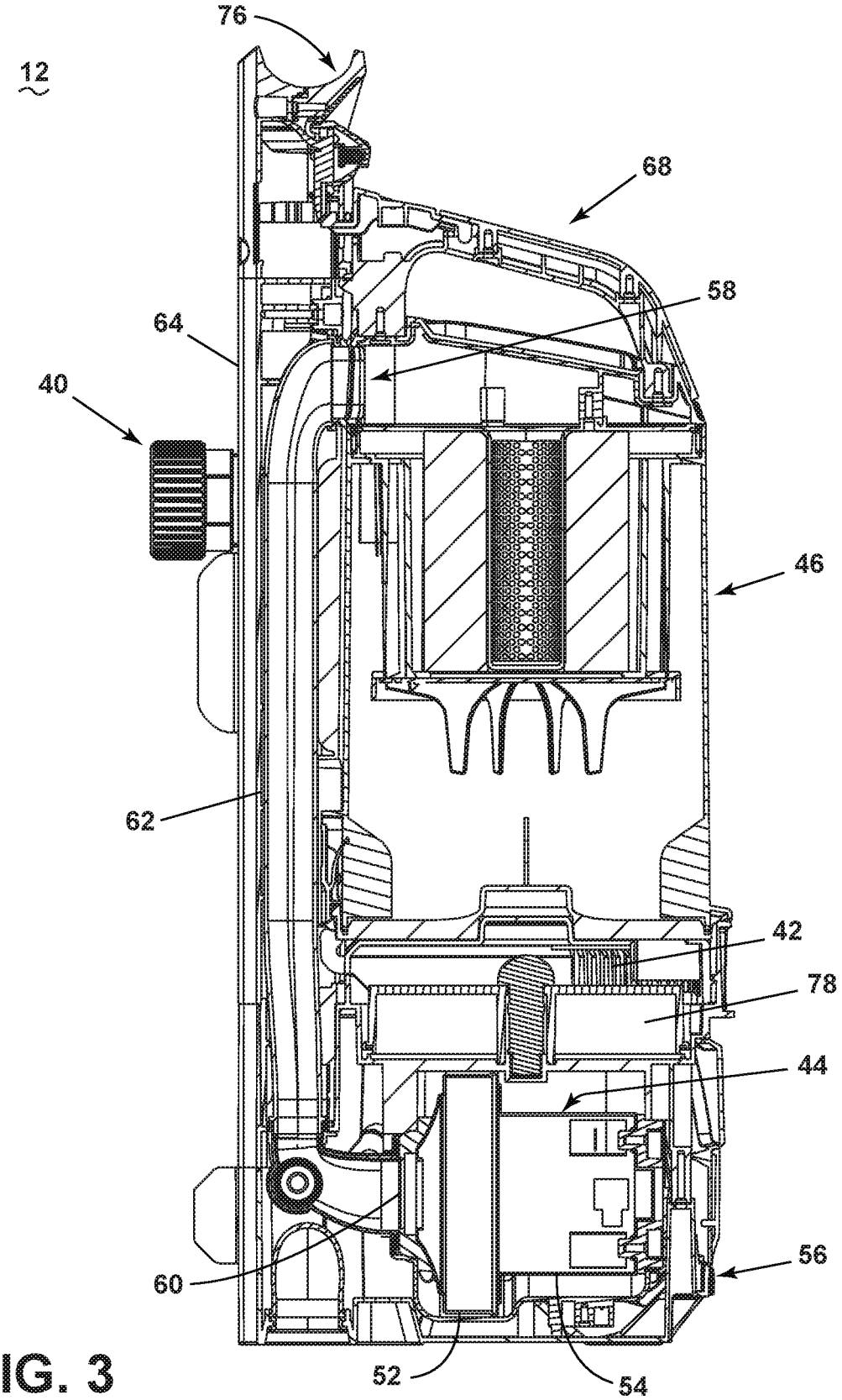
FIG. 3 is a cross-sectional view through a pod of the vacuum cleaner from FIG. 1.

FIG. 3 is a cross-sectional view through the pod 12. The pod 12 includes a hand-carriable body housing the components of a vacuum collection system for creating a partial vacuum to suck up debris (which may include dirt, dust, soil, hair, and other debris) from a surface to be cleaned and collecting the removed debris in a space provided on the pod 12 for later disposal. Additionally, in some embodiments of the invention the vacuum cleaner 10 can have fluid delivery capability, including applying liquid or steam to the surface to be cleaned, and/or fluid extraction capability.

The vacuum collection system can include a working air path through the pod body, and may include a dirty air inlet 40 and a clean air outlet 42. The dirty air inlet 40 and a clean air outlet 42 may be provided on the body of the pod 12. The dirty air inlet 40 may be in fluid communication with the suction nozzle 28 in the floor cleaning head 16 when the pod 12 is received on the upright body 14 (FIG. 1). In the pod mode of operation, the dirty air inlet 40 may be used to directly clean a surface. With additional reference to FIGS. 2 and 6, the pod 12 may further be provided with a vacuum hose 48 and a telescoping wand 50 which can form a portion of the working air path through the body in one or both of the upright and pod modes of operation. In the pod mode, the hose 48 and wand 50 can be extended from the pod 12 and the inlet end of the hose 48 or wand 50 can define a dirty air inlet for the vacuum collection system, with the hose 48 or wand 50 coupled with the dirty air inlet 40 provided on the body of the pod 12.

In addition, the vacuum collection system may include one or more of a motor/fan assembly 44 in fluid communication with the dirty air inlet for generating a working airstream through the working air path, and a debris removal assembly 46 for removing and collecting debris from the working airstream for later disposal. Portions of both the motor/fan assembly 44 and the debris removal assembly 46 can define portions of the working air path through the body.

The motor/fan assembly 44 includes a fan/impeller section 52 and a motor section 54 which are housed in a motor housing 56 of the pod 12. The debris removal assembly 46 and motor housing 56 are in fluid communication with each other when coupled, and can be secured together to form a single, hand-carriable unit. Particularly, the debris removal assembly 46 can have an air outlet 58 that is in fluid communication with an inlet 60 of the motor/fan assembly 44 via a duct 62. As shown herein, the duct can extend within the body of the pod 12, including substantially longitudinally through the pod 12 or parallel to an axis of the debris removal assembly 46. The motor/fan assembly 44 can be provided below the debris removal assembly 46, with an axis of the motor being non-parallel to, and more specifically orthogonal to, the axis of the debris removal assembly 46. It is noted that other arrangements for the motor/fan assembly 44, debris removal assembly 46, and 62 are possible.

The body of the pod 12 can include a spine 64 projecting upwardly from the motor housing 56, which together define a receiver 66 (FIG. 5) on a front side of the pod 12 for receiving and supporting the debris removal assembly 46 on the pod 12.

Referring additionally to FIG, 2, the pod 12 can further include a carry handle 68, a power button 72, and a power source (not shown). The power button 72 can electrically couple the motor/fan assembly 44 to the power source and may be positioned on or adjacent to a portion of the carry handle 68 so that a user can conveniently operate the switch when holding the pod 12 by the carry handle 68. Optionally, a second power button 70 can be provided, and controls operation of the agitator 30—the second power button 70 for the agitator may only be operable to power the agitator when the first power button 72 is on, i.e. when the motor/fan assembly 44 is powered. The power source may be a power cord connected to the body and plugged into a household electrical outlet, or a rechargeable battery. A hose wrap 76 can further be provided on the body for storing at least a portion of the vacuum hose 48, and can be provided at the top of the spine 64 as shown herein.

The carry handle 68 can be provided above or on the top of the debris removal assembly 46, with an axis of the carry handle 68 being non-parallel to, and more specifically orthogonal to, the axis of the debris removal assembly 46. The hose wrap 76 can be provided above and to the rear of the carry handle 68. It is noted that other arrangements for the debris removal assembly 46, carry handle 68, and hose wrap 76 are possible.

The pod 12 can be used to effectively clean a surface by removing debris (which may include dirt, dust, soil, hair, and other debris) from the surface in accordance with the following method. Referring to FIG. 3 in particular, to perform vacuum cleaning in the pod mode, the motor/fan assembly 44 draws in debris-laden air through the air inlet 40 via the hose 48 and into the debris removal assembly 46 where at least some or all debris in the working air is filtered out from the working airstream. The air then passes through the motor/fan assembly 44 and may exit the housing via the clean air outlet 42. In some embodiments, a post-motor filter 78 may be provided between an outlet from the motor/fan assembly 44 and the clean air outlet 42. The debris removal assembly 46 can be periodically emptied of debris by removing the assembly 46 from the pod body Likewise, the post-motor filter assembly 78, as well as any additional filters, can periodically be cleaned or replaced.

Operation in the upright mode can be substantially similar. With the pod 12 secured on the upright body 14, the motor/fan assembly 44 initially draws in debris-laden air through the suction nozzle 28 and working air conduit 32 before entering the hose 48 and the air inlet 40 of the pod 12. The remaining operation is the same.

Figure 4A:
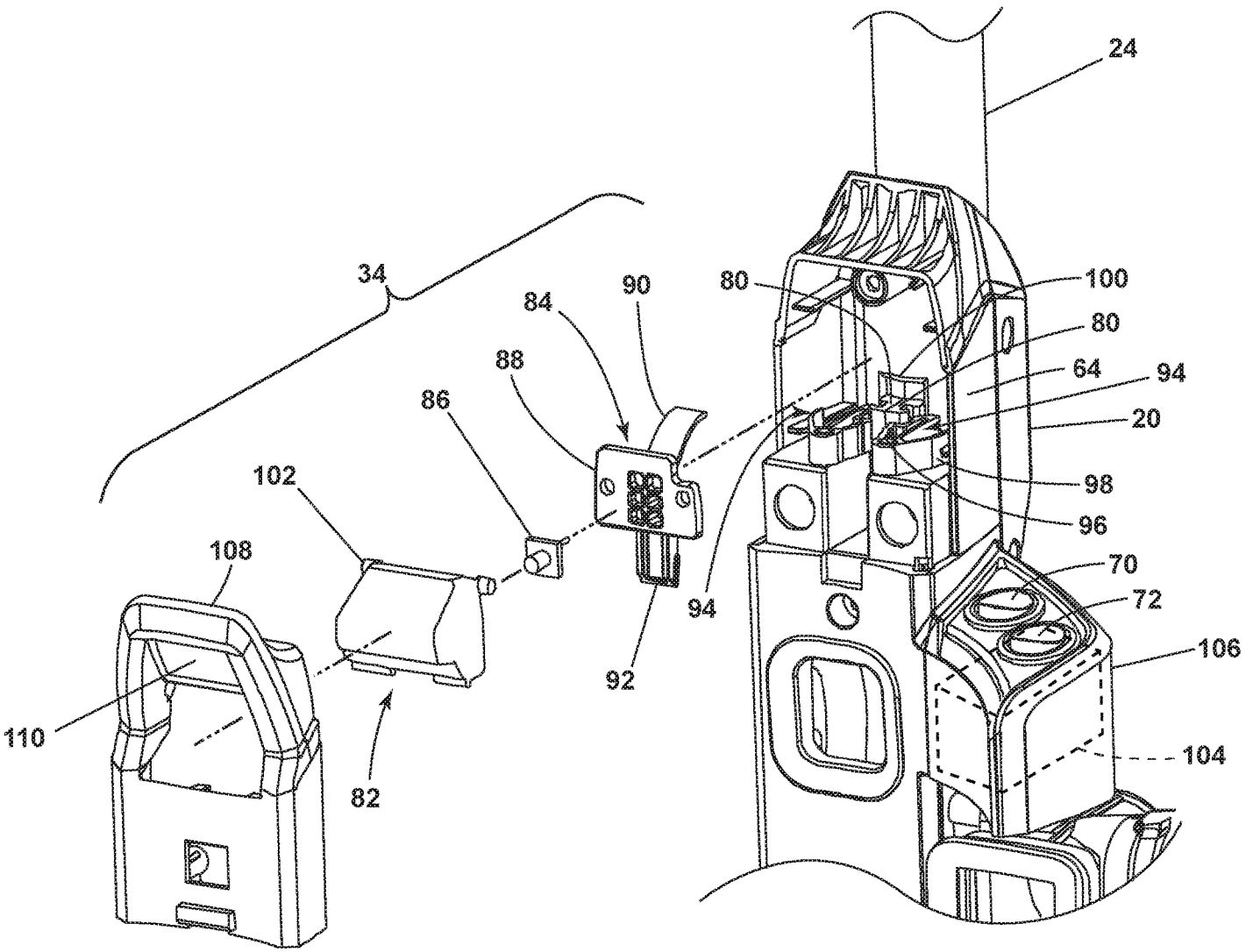
FIG. 4A is a partially exploded view of a portion of the vacuum cleaner from FIG. 1 illustrating a pod release button assembly.

FIG. 4A is a partially exploded view of a portion of the vacuum cleaner 10 from FIG. 1 showing the pod release button assembly 34. In FIG. 4A, the debris removal assembly 46 is not shown for clarity. The pod release button assembly 34 can be provided at least partially on the spine 64 of the pod 12 and engages a hanger or catch 80 on the handle 24 of the upright assembly 14 to secure the pod 12 to the upright assembly 14. The pod release button assembly 34 comprises a pod release button 82, a button frame 84 mounted to the rear of the button 82 and a light 86, such as an LED, mounted to the button frame 82 and configured to illuminate the pod release button 82. The button 82 can be molded out of transparent or translucent material. The button frame 84 can include an LED mount 88, a biasing element or spring portion 90 for biasing the button 82 outwardly, and a wedge portion 92.

In one embodiment, the pod release button 82 is always backlit, i.e. the light 86 is on, when the main power switch operated by the power button 72 is on. In an alternate embodiment, the light 86 can be configured to only illuminate when the main power switch is on and the pod 12 is docked on the upright body 14. In this case, the light 86 can turn off upon removing the pod 12 from the upright body 14, and turns on upon re-docking the pod 12 on the upright body 14.

The pod release button assembly 34 further includes one or more pod release latches 94 which are configured to engage the catch 80 on the handle 24. As shown herein, two latches 94 are provided and are pivotally mounted on pivot pins 96 within the pod housing or spine 64 and include molded-in springs 98 that bias the latches 94 towards the catch 80 for retaining the pod 12 on the upright body 14.

When the pod 12 is secured, the catch 80 is sandwiched between the two latches 94. The latches 94 can project outwardly from the pod 12 to engage the catch 80, or, as illustrated herein, the spine 64 of the pod 12 can include a window opening 100 in the spine 64 through which the catch 80 is inserted.

The wedge portion 92 mounted to the button 82 selectively opens the pod release latches 94 to release the pod 12 from the mating catch 80 on the upright body 14. The button 82 is pivotally mounted within the spine 64 by a pivot pin 102 on an upper portion of the button 82. Depressing the button 82 causes the button 82 to rotate about the pivot pin 102 and the wedge portion 92, which is provided at a lower portion of the button 82, is moved rearwardly between the latches 94 to force the latches 94 apart, thereby releasing the catch 80.

In this configuration, the LED 86 moves together with the pod release button 82 when the button 82 is depressed. The LED 86 can be connected to a PCB 104 mounted in a power switch mounting chamber 106 which also carries the power buttons 70, 72.

In the embodiment shown herein, a spine cap 108 mounts on the spine 64 of the pod 12 and encloses the pod release button 82. A badge 110 can optionally be provided on the spine cap 108 and can indicate the function of the pod release button 82. The spine cap 108, along with a rear portion of the spine 64, can define the hose wrap 76 above the pod release button 82.

Figure 4B:
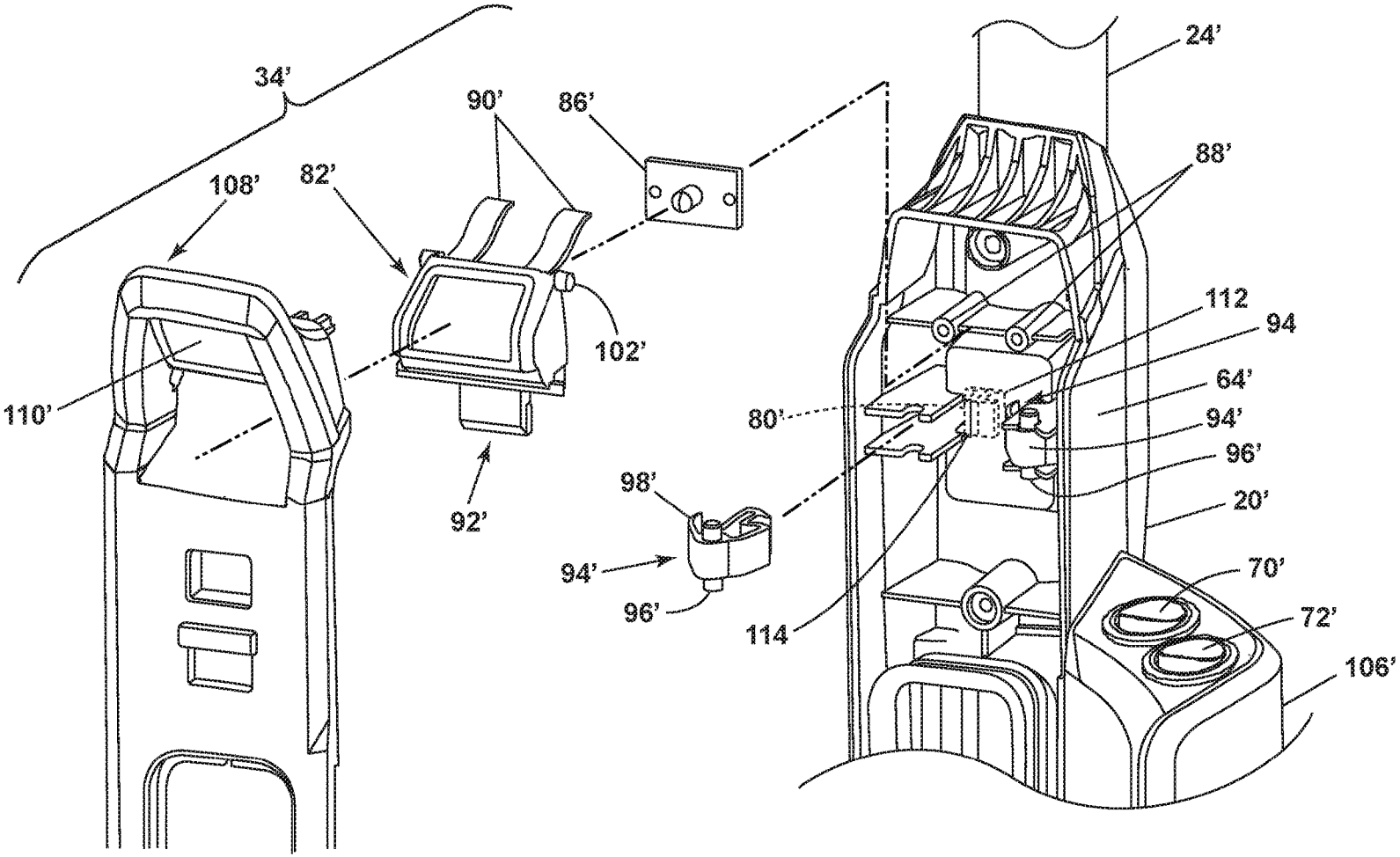
FIG. 4B is a partially exploded view of a portion of the vacuum cleaner from FIG. 1 illustrating an alternative embodiment of a pod release button assembly.

FIG. 4B is a partially exploded view of a portion of the vacuum cleaner 10 from FIG. 1 showing an alternate configuration for a pod release button assembly 34'. In FIG. 4B, the debris removal assembly 46 is not shown for clarity. The pod release button assembly 34' of FIG. 4B is substantially similar to the assembly shown in FIG. 4A, with like elements bearing a prime (') symbol, except that components of the button frame have been combined with the pod release button 82' in a single component. Thus the pod release button 82' includes the wedge portion 92' for opening pod release latches 94' and at least one spring portion 90' for biasing the button 82' outwardly. Additionally, the LED mount 88' of FIG. 4B is formed by screw bosses in the spine 64'. In this configuration, the LED 86' is stationary with respect to the movable pod button 82'. Also, instead of a single window opening through which the entire catch 80' projects, the spine 64' can include a pocket 112 into which the catch 80' is inserted, and the pocket 112 can have window openings 114 on opposing sides of the pocket 112 through which portions of the latches 94' can project to sandwich the catch 80' therebetween. Otherwise, the structure and operation of the pod release button assembly 34' of FIG. 4B is substantially the same as the structure and operation of assembly shown in FIG. 4A.

Figure 5:
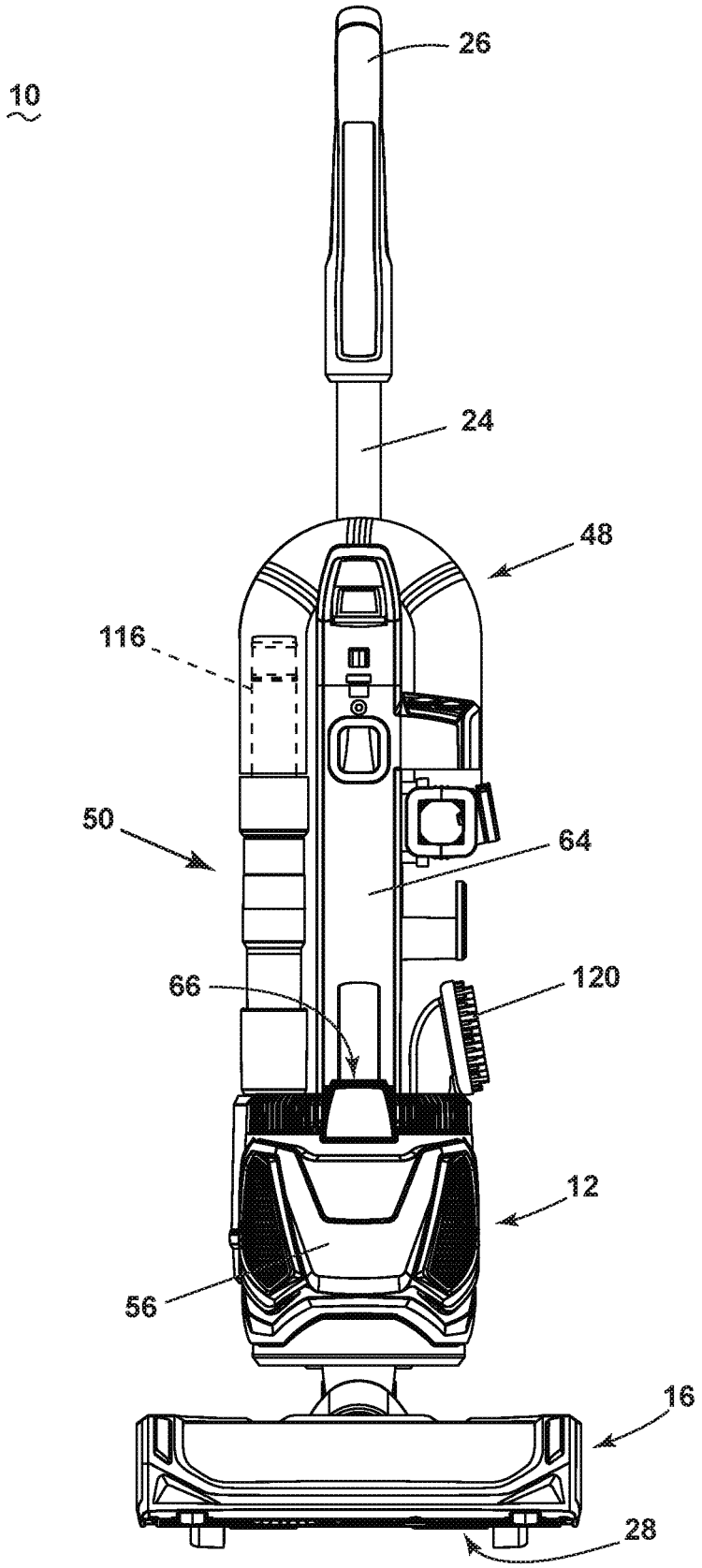
FIG. 5 is a front view of the vacuum cleaner from FIG. 1, wherein a debris removal assembly is removed for clarity.

FIG. 5 is a front view of the vacuum cleaner 10 from FIG. 1, with the debris removal assembly 46 removed for clarity. As discussed above, the pod 12 can include vacuum hose 48 and telescoping wand 50 which form a portion of the working air path through the vacuum cleaner 10 in both the upright and pod modes of operation. In the upright mode, shown in FIG. 5, the hose 48 and wand 50 can be in fluid communication with the suction nozzle 28. In the pod mode, the pod 12 is separated from the upright body 14, for example as shown in FIG. 2, and the hose 48 and wand 50 can be extended from the pod 12 and the inlet end of the wand 50 or hose 48 can define a dirty air inlet for the working air path. Optionally, the vacuum cleaner 10 can also be operated in an above-the-floor cleaning mode, shown in FIG. 6, where the pod 12 is mounted on the upright body 14, but the hose 48 and wand 50 can be extended from the pod 12 and the inlet end of the wand 50 or hose 48 can define a dirty air inlet for the working air path. It is noted that the vacuum hose 48 is flexible and is configured to bend and flex about its longitudinal axis during operation without elastic deformation, while the telescoping wand 50 is substantially rigid, and is not intended to bend or flex about its longitudinal axis during operation.

Figure 6:
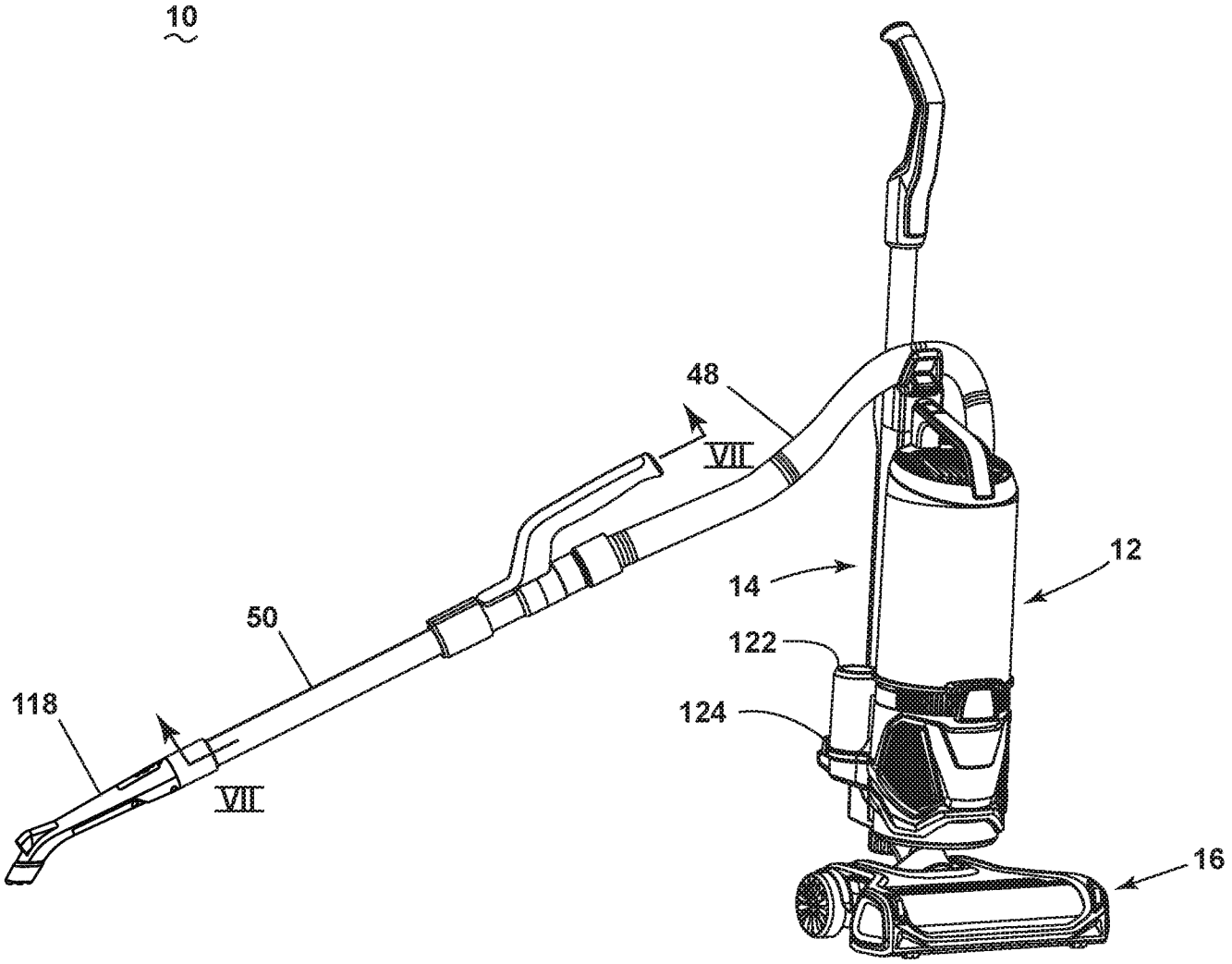
FIG. 6 is a perspective view of the vacuum cleaner from FIG. 1, wherein a wand is detached for an above-the-floor mode of operation.

A portion 116 of the telescoping wand 50 can protrude into the hose 48 when the wand 50 is retracted and in the storage position mounted on the pod 12, as shown in FIG. 5. With the wand 50 stored inside the hose 48, a compact storage is provided, while at the same time maximizing the reach of the wand 50 when extended to provide a longer total extension of the vacuum cleaner 10 between the hose 48 and wand 50. FIG. 6 shows the wand 50 detached for the above-the-floor cleaning mode and extended from the hose 48. An accessory tool 118, such as but not limited to a crevice tool, can optionally be employed with the wand 50 in the pod mode or in the above-the-floor cleaning mode as shown in FIG. 6. Other accessory tools include a dust brush 120, or an upholstery tool, a stair tool, or an air-turbine-powered brush (not shown).

When not in use, the wand 50, crevice tool 118, dust brush 120, and any other accessory tools provided, can optionally be stored on the pod 12 or the upright body 14. For example, in the embodiment illustrated herein, the wand 50 is stored in a wand receiver 122 provided on the pod 12, the crevice tool 118 is stored in a crevice tool receiver 124 provided on the pod 12, and the dust brush 120 is stored in a dust brush receiver 126 (FIG. 1) provided on the frame 20 of the upright body 14. It is noted that for the upright mode of operation, the wand receiver 122 can form a portion of the working air path between the base 16 and the pod 12.

Figure 7:
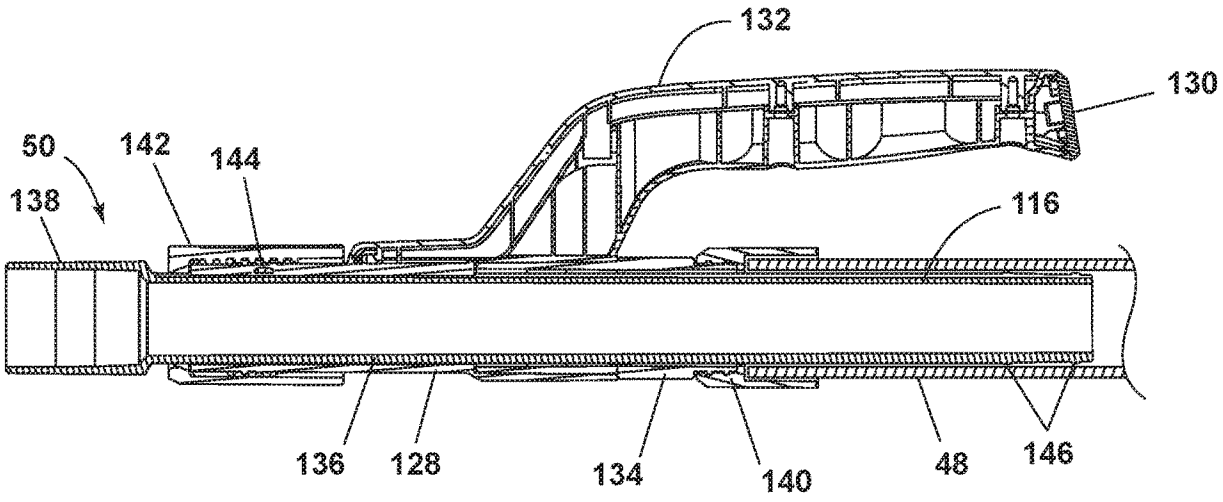
FIG. 7 is a sectional view through a hose and wand assembly of the vacuum cleaner from FIG. 1, showing the wand in a retracted position.

FIG. 7 is a sectional view through an assembly of the hose 48 and wand 50, showing the wand 50 in a retracted position. The wand 50 further includes a wand handle housing 128 that includes an elongated, rigid first conduit and a handle grip 132 extending from the handle housing 128, a connector 134 coupling the handle housing 128 to the hose 48, and a telewand 136 that includes an elongated, rigid second conduit that is configured to telescope inside the handle housing 128 and connector 134, as well as inside the hose 48.

As shown, in one embodiment, the handle grip 132 can extend upwardly and rearwardly from the handle housing 128 such that one end 130 of the handle grip 132 is free or unconnected to the wand 50. The free end 130 can further extend over a portion of the hose 48. The handle grip 132 can be formed integrally with or separately from the handle housing 128. The handle grip 132 can further include an overmolded soft grip for providing a comfortable hand grip to the user.

As noted above, the wand 50 includes a portion 116 that protrudes into the hose 48 in the retracted position; the retractable portion 116 is an end of the telewand 136, as shown in FIG. 7. The opposite end of the telewand 136 can include a wider conduit section 138 that limits the amount the telewand 136 may retract into the handle housing 128 and hose 48. The wider conduit section 138 has a diameter than is larger than the handle housing 128. The hose 48 includes a hose cuff 140 received on an end of the connector 134. The opposite end of the connector 134 is received by the handle housing 128. A threaded cuff 142 on the handle housing 128 engages with a telewand locking ring 144 to releasably lock the telewand 136 at a desired extension length.

Figure 8:
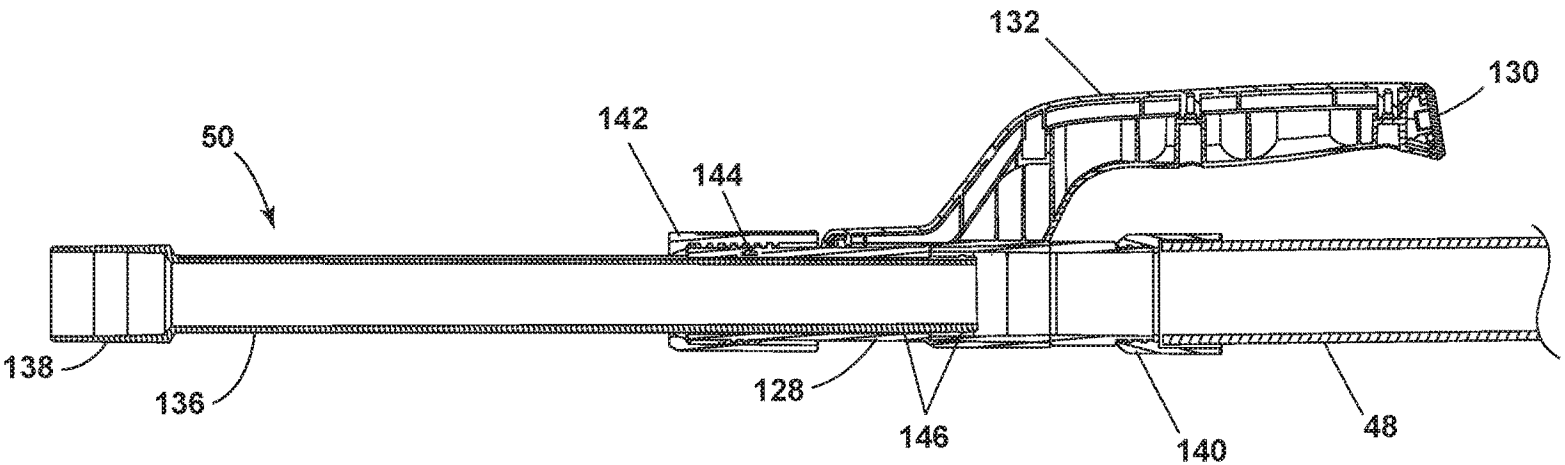
FIG. 8 is a sectional view similar to FIG. 7, showing the wand in an extended position.

FIG. 8 is a sectional view through the assembly of the hose 48 and wand 50, showing the wand 50 in an extended position. To extend the wand 50, the threaded cuff 142 is loosened, the telewand 136 is slid to a desired extension length, and the threaded cuff 142 is re-tightened on the telewand locking ring 144. Detents 146 on the telewand 136 prevent the telewand 136 from extending completely out of the connector 136.

Figure 9:
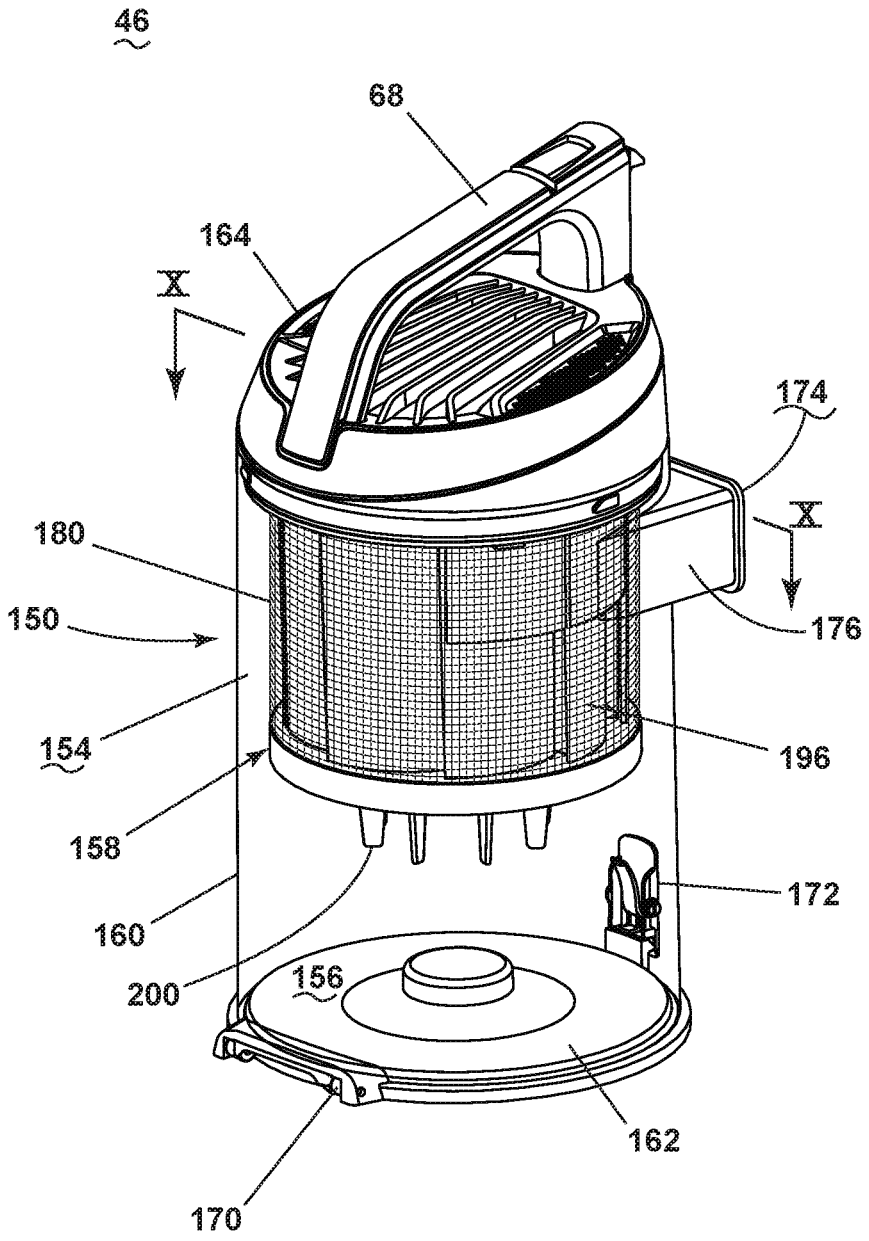
FIG. 9 is a perspective view of a debris removal assembly for the vacuum cleaner from FIG. 1.
Figure 10:
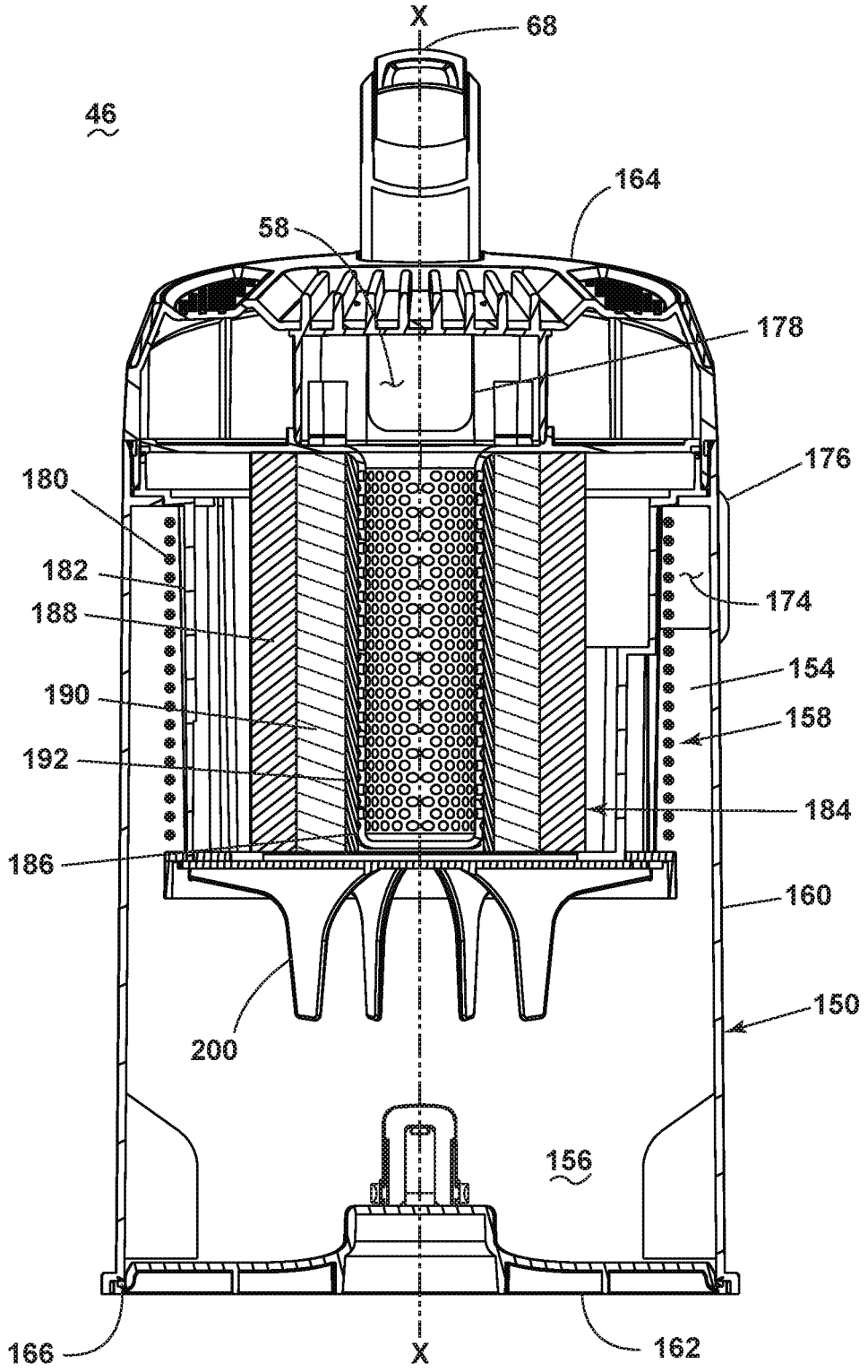
FIG. 10 is a cross-sectional view of the debris removal assembly taken through line X-X of FIG. 9.

FIG. 9 is a perspective view of the debris removal assembly 46 for the vacuum cleaner 10 from FIG. 1 and FIG. 10 is a cross-sectional view through the debris removal assembly 46 from FIG. 9. The debris removal assembly 46 can include a filter assembly for separating contaminants from a working airstream and a dirt tank for receiving and collecting separated contaminants. The filter assembly can include any of a cyclonic or centrifugal separator, a flexible and air-permeable filter bag, or other air filtering means, or combinations thereof, provided downstream of the dirty air inlet 40 and upstream of the motor/fan assembly 44, with the working air path extending through the filter assembly.

In one embodiment of the present disclosure, the debris removal assembly 46 includes at least a body 150 having an air inlet 174 in fluid communication with the dirty air inlet 40 and the air outlet 58 as discussed above, which is fluidly upstream of the clean air outlet 42, and a multi-layer filtration stage 158 within the body 150 between the air inlet 174 and the air outlet 58.

In the illustrated embodiment, the debris removal assembly 46 comprises a cyclonic separation module with the body 150 defined by a dirt tank 150 comprising a housing at least partially defining a cyclone chamber 154 for separating contaminants from a dirt-containing working airstream and an associated dirt collection chamber 156 which receives contaminants separated by the cyclone chamber 154. The debris removal assembly 46 can further include the multi-layer filtration stage 158, also referred to herein as a second filtration stage 158. The first cyclone stage and second filtration stage 158 can be centered on a central axis X of the module/assembly 46, which can extend longitudinally through the dirt tank 150. Further, the first and second stages can be concentric, with the second stage positioned within the first stage and both centered on the central axis X. It is noted that while a single stage cyclone separator is illustrated herein, it is also contemplated that embodies of the invention can be configured with additional cyclonic separation stages.

The dirt tank 150 includes a side wall 160, a bottom wall 162, and a cover 164. As shown in FIG. 9, the side wall 160 can be at least partially transparent or translucent in order for a user to view the contents of the debris removal assembly 46. The side wall 160 is illustrated herein as being generally cylindrical in shape, with a diameter that remains constant or increases in a direction toward the bottom wall 162. The side wall 160 includes a lower or bottom edge 166 that defines a debris outlet for the collection chamber 156. The bottom wall 162 in the illustrated embodiment comprises a dirt door 162 that can be selectively opened, such as to empty the contents of the collection chamber 156. The cover 164 can include the carry handle 68 that can be gripped by a user to facilitate lifting and carrying the entire vacuum cleaner 10, just the pod 12, or just the debris removal assembly 46. The cover 164 is removably connected to the dirt tank 150 one or more connections therebetween. In one example, the connection can comprise one or more bayonet hooks on the cover 164 that engage one or more corresponding recesses on an upper inside portion of the side wall 160 (not shown). The cover 164 can be removed from the dirt tank 150 by twisting the cover 164 relative to the dirt tank 150 to release the bayonet hooks from the recesses and then lifting the cover 164 off of the dirt tank 150.

The dirt door 162 is pivotally mounted to the side wall 160 by a hinge 170. A door latch 172 is provided on the side wall 160, opposite the hinge 170, and can be actuated by a user to selectively release the dirt door 162 from engagement with the bottom edge 166 of the side wall 160. The door latch 172 is illustrated herein as comprising a latch that is pivotally mounted to the side wall and spring-biased toward a closed position shown in FIG. 9. By pressing the upper end of the door latch 172 toward the side wall 160, the lower end of the door latch 172 pivots away from the side wall 160 and releases the dirt door 162, under the force of gravity, to an open position, allowing accumulated dirt to be emptied from the collection chamber 156 through the debris outlet defined by the bottom edge 166 of the dirt tank 150.

The air inlet 174 can comprise an air inlet to the cyclone chamber 154, and can be at least partially defined by an inlet conduit 176. The inlet conduit 176 can extend tangentially from the side wall to define a tangential air inlet 174. The air outlet 58 from the debris removal assembly 46 can be at least partially defined by an outlet conduit 178 extending from the cover 164. The inlet conduit 176 is in fluid communication with the pod air inlet 40 (FIG. 3), and can further be in fluid communication the suction nozzle 28 (FIG. 1) depending on the operational mode of the vacuum cleaner 10. The outlet conduit 178 is in fluid communication with the motor/fan assembly 44 (FIG. 3) via the duct 62.

The second filtration stage 158 can include several filtration stages or layers. In order from upstream to downstream with respect to the working airflow, the layers are: an outer fine mesh screen 180; a first louvered exhaust grill 182; a cylindrical multi-layer filter 184; and a perforated inner exhaust grill 186 fluidly connected to the air outlet conduit 178. The multi-layer filter 184 is mounted between the first louvered exhaust grill 182 and the perforated inner exhaust grill 186 and can comprise multiple layers of filtration material. Each layer can be distinct, and can comprise a different filtration material. As shown, the multi-layer filter 184 comprises at least: a first filtration layer 188; a second filtration layer 190; and a third filtration layer 192. In one example, multi-layer cylindrical filter 184 can comprise a combination of filtration materials, including, but not limited to, a combination of foam and paper material. In one particular example, the first and second filtration layers 188, 190 can comprise foam, and the third filtration layer 192 can comprise an inner woven fiber filter layer. The multi-layer cylindrical filter 184 can be removed through the top by removing the lid 164.

Figure 11:
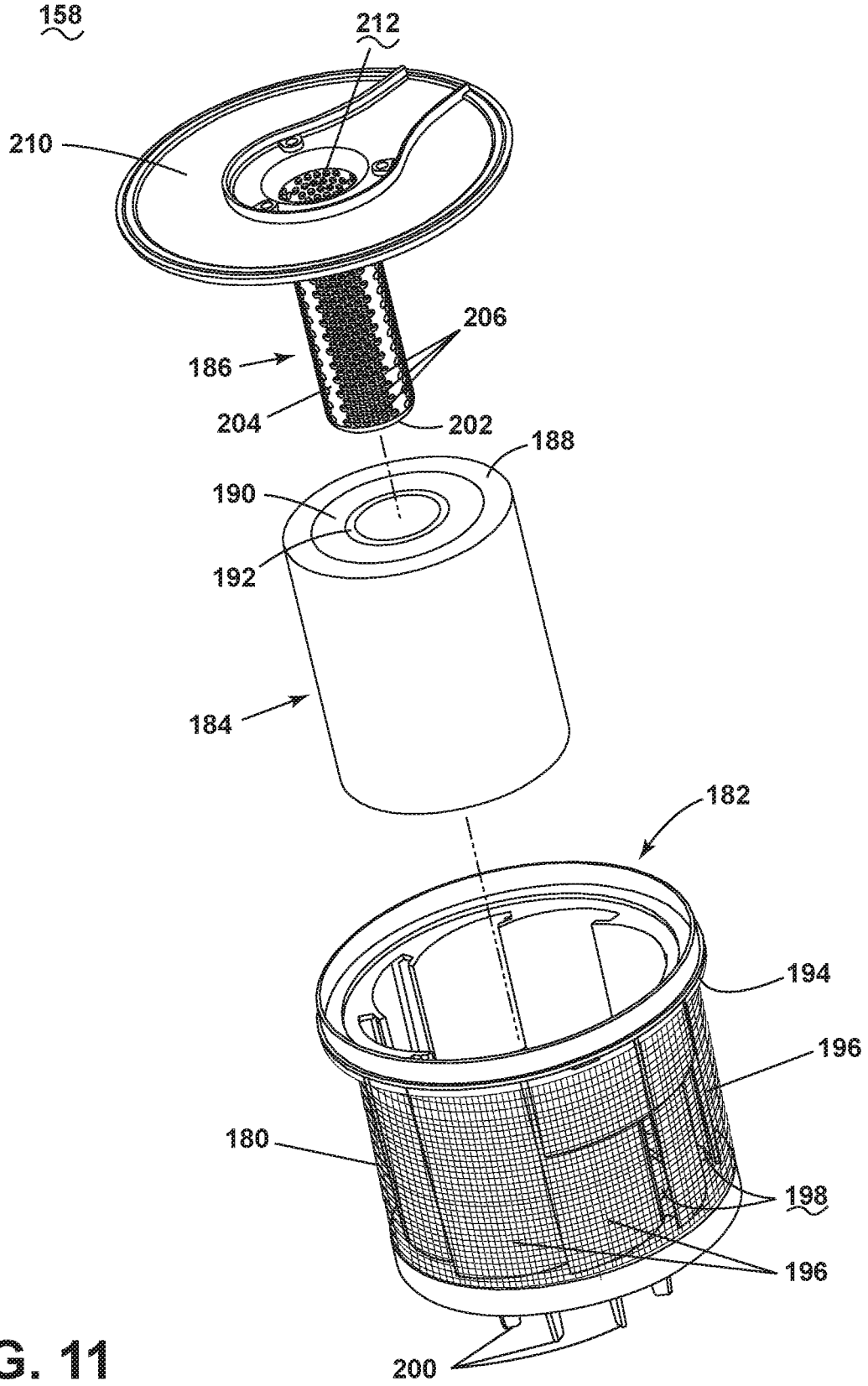
FIG. 11 is an exploded view of a filtration stage of the debris removal assembly of FIG. 9.

With additional reference to FIG. 11, the louvered exhaust grill 182 includes a generally cylindrical body 194 having a plurality of vanes or louvers 196 extending longitudinally between upper and lower ends of the body 194. The louvers 196 form corresponding air flow openings 198 therebetween through which working air can pass. As illustrated, the louvers 196 are elongated longitudinally and oriented parallel to the central axis X.

The lower end of the body 194 optionally includes tines 200 that protrude longitudinally along the central axis X. The tines 200 are configured to collect and prevent re-entrainment of hair and other debris in the collection chamber 156. The lower free ends of the tines 200 are spaced from the dirt door 162, such that the area below the tines 200 forming the collection chamber 156 is unobstructed. The tines 200 are elongated such that the tines 200 have a length that is greater than their width or thickness, and can have a tapered shape which tends to improve shedding and release of debris when the dirt door 162 is opened.

The outer fine mesh screen 180 can be supported on the cylindrical body 194 forming the louvered exhaust grill 182, and is disposed radially outwardly from the louvers 196. The mesh screen 180 can comprise a fine, air permeable mesh screen material that is fastened or otherwise coupled with to the cylindrical body around the entire perimeter to cover the louvers and air flow openings. The mesh screen 180 is configured to prevent dirt of a certain size from passing through and has a mesh size defined by the number of openings per linear inch of mesh material. In one example, the mesh screen 180 can comprise a 40 sieve mesh, such as, but not limited to, a stainless steel mesh. It is noted that the mesh size of the mesh screen 180 may be exaggerated in the figures for clarity.

The first filtration layer 188 is configured to prevent dirt of a certain size from passing through and has a filtration size defined by the number of pores per linear inch of material. The filtration size can be selected to filter out smaller particles than the outer fine mesh screen 180 is capable of filtering out. In one example, the first filtration layer 188 can comprise a foam having approximately 45 pores per linear inch (PPI), ±5 PPI. One suitable foam layer 188 can further have an apparent density of 22±2 kilograms per cubic meter ($kg/m^3$) as determined in accordance with Chinese Standard GB/T6343, a tensile strength of ≥85 kilopascal (kPa) as determined in accordance with Chinese Standard GB/T6344, and/or an elongation at break of ≥150% as determined in accordance with Chinese Standard GB/T6344.

The second filtration layer 190 is configured to prevent dirt of a certain size from passing through and can have a filtration size selected to filter out smaller particles than the first filtration layer 188 is capable of filtering out. In one example, the second filtration layer 190 can comprise a foam having approximately 60 PPI, ±5 PPI. One suitable foam layer 190 can further have an apparent density of 22±2 $kg/m^3$ as determined in accordance with Chinese Standard GB/T6343, a tensile strength of ≥85 kPa as determined in accordance with Chinese Standard GB/T6344, and/or an elongation at break of ≥130% as determined in accordance with Chinese Standard GB/T6344.

The third filtration layer 192 is configured to prevent dirt of a certain size from passing through and can have a filtration size selected to filter out smaller particles than the second filtration layer 190 is capable of filtering out. In one example, the third filtration layer 192 can comprise a woven fibrous layer, such as, but not limited to, a fibrous layer having a fiber composition of 95% polyethylene terephthalate (PET) and 5% bonding fiber. One suitable fibrous layer 192 can further have a surface density of 300±5 grams per square meter ($g/m^2$), a tensile strength of ≥100% in the machine direction (MD) and ≥30% in the cross direction (CD) as determined in accordance with Chinese Standard GB/T 3923.1-1997, and/or an elongation at break of ≥100% in the machine direction (MD) and ≥110% in the cross direction (CD) as determined in accordance with Chinese Standard GB/T 3923.1-1997.

The perforated inner exhaust grill 186 includes a generally cylindrical body 202 having a perforated side wall 204 extending longitudinally between upper and lower ends of the body 202. The perforated side wall 204 includes a plurality of perforations or holes 206 forming air flow openings through which working air can pass. In one example, the holes 206 can comprise an opening diameter of about 1 mm-3 mm. As illustrated, the side wall 204 extends longitudinally and is oriented parallel to the central axis X. The perforations or holes 206 can extend orthogonally through the side wall 204 or at an angle through the side wall 204, and in either case are transverse to the central axis X. The upper and lower ends of the body 202 meet the cylindrical body 194 of the louvered exhaust grill 182 at air-tight joints to ensure that working air is forced through the perforations. A plate 210 is provided at the upper end of the body 202 and extends radially outwardly with respect to the side wall 204. An outlet opening 212 through the plate 210 opens to an air passage between the interior of the grill 186 and the air outlet 58 that passes through the cover 164.

Figure 12:
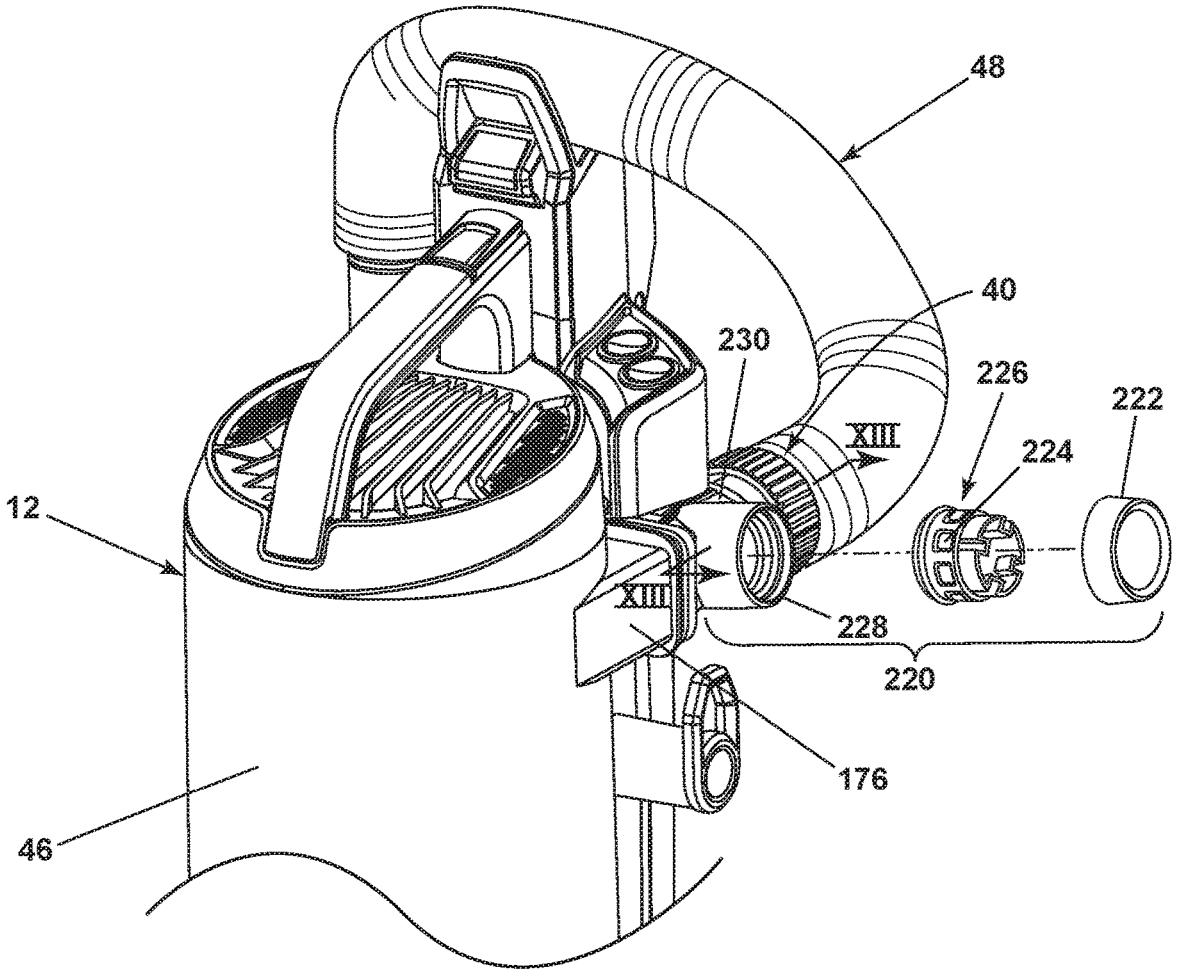
FIG. 12 is a partially exploded view of a portion of the vacuum cleaner from FIG. 1 illustrating a bleed valve in the working air path.

FIG. 12 is a partially exploded view of the vacuum cleaner 10 from FIG. 1 illustrating a bleed valve 220 in the working air path. In some embodiments, a bleed valve 200 can be provided in the working air path of the vacuum cleaner 10 for drawing bleed air into the working air path. In the illustrated embodiment the bleed valve 200 is provided in the working air path between the vacuum hose 48 and the inlet to the debris removal assembly 46 defined by the inlet conduit 176. The bleed valve 220 can comprise a twistable bleed valve with a vent knob 222 that selectively opens at least one vent opening 224. The bleed valve 220 can further include a vent insert 226 that is received in a port 228 in a sidewall of the air inlet 40 formed by a working air conduit 230 between the hose 48 and the inlet conduit 176 of the debris removal assembly 46, and the vent insert 226 can comprise the at least one vent opening 224. In some embodiments, multiple vent openings 224 or holes can be provided in the vent insert 226.

The vent knob 222 can be oriented co-axially with the vent inlet 226, and is fixed with the vent insert 226 using any suitable joining method, such as using a mechanical fastener or screw. The valve insert 226 further includes a threaded sleeve 232 that is threaded with the port 228 for rotation of the valve insert 226 relative to the port 228. Manipulation of the knob 222 causes rotation of the valve insert 226 within the port 228.

Figure 13:
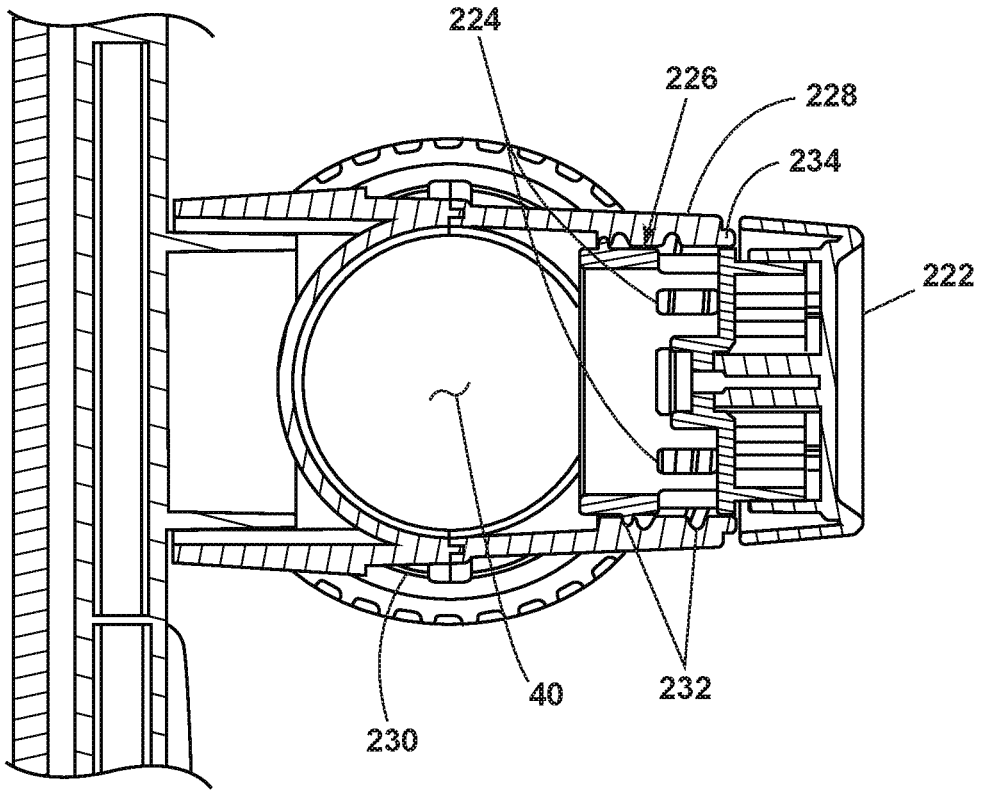
FIG. 13 is a sectional view through the bleed valve taken through line XIII-XIII of FIG. 11, where the bleed valve is closed.

FIG. 13 is a sectional view through the bleed valve 220 of FIG. 12, where the bleed valve 220 is closed. When closed, a sealing surface 234 on the port 228 seals against the vent insert 226, and no working air bleeds into the working air path through the vent openings 224.

Figure 14:
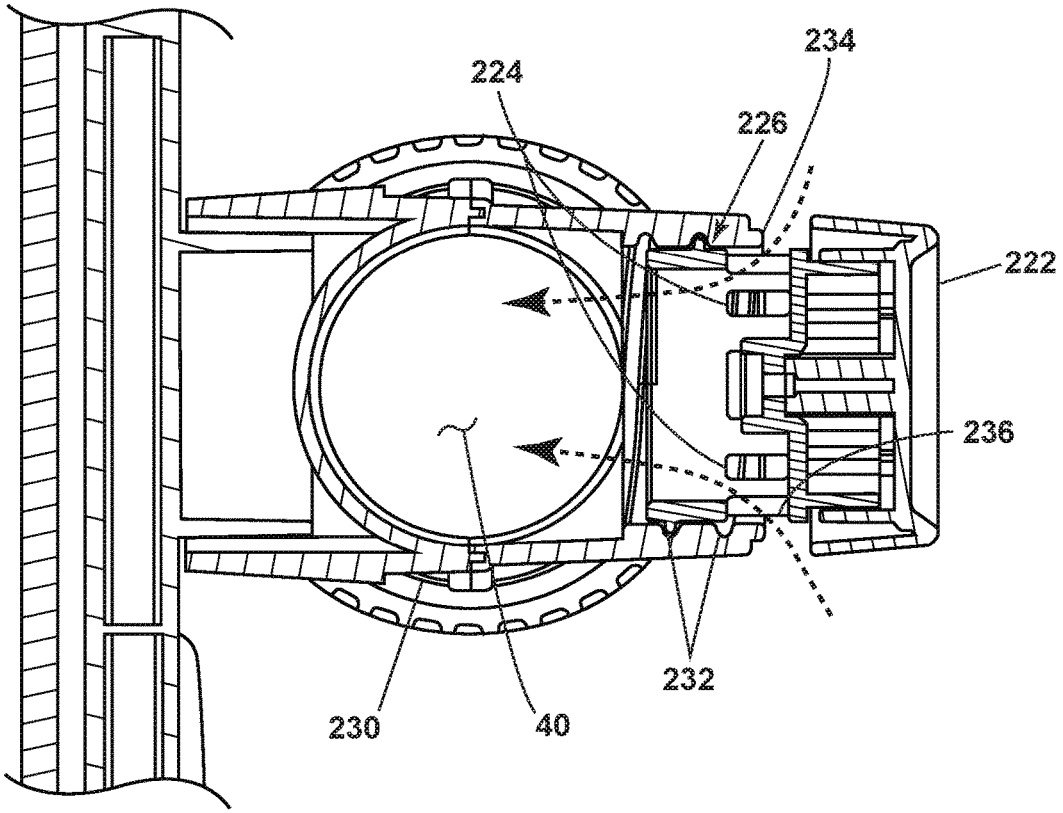
FIG. 14 is a sectional view similar to FIG. 14, where the bleed valve is open.

FIG. 14 is a sectional view through the bleed valve 220 of FIG. 12, where the bleed valve 220 is open. Rotating the vent knob 222 will open or close the valve 220. Rotating the vent knob 222 to an open position correspondingly rotates the valve insert 226, and the threaded connection between the insert 226 and port 228 causes translation of the insert 226 outwardly away from the sealing surface 234. When open, ambient air leaks through a gap 236 between the port 228 and insert 226, and into the working air path via the vent openings 224 as indicated by the arrows in FIG. 14. The bleed air reduces the level of suction or lift at the air inlet of the working air path, which may be the suction nozzle 28, the dirty air inlet 40, or the end of the wand 50 or hose 48, depending on the mode of operation.

To the extent not already described, the different features and structures of the various embodiments of the invention, may be used in combination with each other as desired, or may be used separately. That one vacuum cleaner 10 is illustrated herein as having all of these features does not mean that all of these features must be used in combination, but rather done so here for brevity of description. Furthermore, while the vacuum cleaner 10 shown herein includes a detachable pod 12 such that the vacuum cleaner 10 has an upright mode of operation and a hand-carried mode of operation, at least some embodiments of the invention, not illustrated herein, can be used in a vacuum cleaner configured as a conventional upright or stick vacuum cleaner without a pod module, a canister vacuum cleaner, an autonomous vacuum cleaner, or a hand-held vacuum cleaner. Still further, the vacuum cleaner 10 can additionally have fluid delivery capability, including applying liquid or steam to the surface to be cleaned, and/or fluid extraction capability. Thus, the various features of the different embodiments may be mixed and matched in various vacuum cleaner configurations as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a working air path comprising a dirty air inlet and a clean air outlet;

a motor/fan assembly in fluid communication with the dirty air inlet for generating a working airstream through the working air path; and a debris removal assembly for removing and collecting debris from the working airstream for later disposal, the debris removal assembly having a central axis and comprising:

a debris removal assembly body having an air inlet in fluid communication with the dirt air inlet and an air outlet fluidly upstream of the clean air outlet; and a multi-layer filtration stage provided within the debris removal assembly body, and comprising:

a louvered exhaust grill comprising a generally cylindrical body having a plurality of louvers extending longitudinally relative to the central axis between upper and lower ends of the generally cylindrical body and forming air flow openings therebetween;

a mesh screen disposed radially outwardly about a radial perimeter of the louvered exhaust grill; and a multi-layer filter including a plurality of layers of filtration material, the multi-layer filter mounted radially interior within the louvered exhaust grill, fluidly downstream of the air flow openings.

2. The vacuum cleaner of claim 1, wherein the louvers are elongated longitudinally and oriented parallel to the central axis.

3. The vacuum cleaner of claim 1, wherein the multi-layer filter is cylindrical and is elongated longitudinally relative to the central axis.

4. The vacuum cleaner of claim 1, wherein the multi-layer filter comprises a first filtration layer, a second filtration layer, and a third filtration layer.

5. The vacuum cleaner of claim 4, wherein the first and second filtration layers comprise foam, and the third filtration layer comprises a woven fibrous layer disposed radially inwardly of the first and second filtration layers relative to the central axis.

6. The vacuum cleaner of claim 4, wherein the second filtration layer is disposed radially inwardly of the first filtration layer and has a filtration size configured to filter out smaller particles than the first filtration layer, and the third filtration layer is disposed radially inwardly of the second filtration layer and has a filtration size configured to filter out smaller particles than the second filtration layer.

7. The vacuum cleaner of claim 1, further comprising a plurality of tines extending below the multi-layer filtration stage.

8. The vacuum cleaner of claim 7, wherein the tines protrude from the lower end of the generally cylindrical body of the louvered exhaust grill.

9. The vacuum cleaner of claim 1, further comprising a dirt collection chamber defined within the debris removal assembly body.

10. The vacuum cleaner of claim 9, further comprising a plurality of tines extending below the multi-layer filtration stage, wherein the tines are spaced from and do not contact a bottom wall of the dirt collection chamber.

11. The vacuum cleaner of claim 1, wherein the multi-layer filtration stage further comprises a perforated exhaust grill fluidly connected to the air outlet, wherein the multi-layer filter is mounted between the louvered exhaust grill and the perforated exhaust grill.

12. The vacuum cleaner of claim 11, wherein the perforated exhaust grill comprises a generally cylindrical body having a side wall with a plurality of perforations therein defining air flow openings through the side wall.

13. The vacuum cleaner of claim 1, wherein the mesh screen is supported on the generally cylindrical body of the louvered exhaust grill.

14. The vacuum cleaner of claim 1, wherein the mesh screen comprises an air permeable mesh screen material covering the plurality of louvers and air flow openings.

15. The vacuum cleaner of claim 1, wherein the debris removal assembly further comprises a cyclone separation stage fluidly upstream of the multi-layer filtration stage.

16. The vacuum cleaner of claim 1, wherein the debris removal assembly comprises a cyclonic separation module, with the debris removal assembly body defined by a dirt tank at least partially defining a cyclone chamber and a dirt collection chamber configured to receive contaminants separated by the cyclone chamber.

17. The vacuum cleaner of claim 1, further comprising a housing that includes a floor cleaning head and an upright body pivotally connected to the floor cleaning head, wherein the dirty air inlet comprises a suction nozzle is provided on the floor cleaning head.

18. The vacuum cleaner of claim 17, wherein the upright body includes a detachable pod, and the pod carries the debris removable assembly and the motor/fan assembly.

19. The vacuum cleaner of claim 18, further comprising a pod release button assembly comprising:

a latch coupling the pod to the upright body;

a release button operably coupled with the latch for selectively releasing the latch; and a light mounted inside the release button and configured to illuminate the release button.

20. The vacuum cleaner of claim 1, wherein the vacuum cleaner comprises a hand-carriable unit, and the debris removal assembly is detachably mounted on the hand-carriable unit.

21. A vacuum cleaner, comprising:

a working air path comprising a dirty air inlet and a clean air outlet;

a motor/fan assembly in fluid communication with the dirty air inlet for generating a working airstream through the working air path; and a debris removal assembly for removing and collecting debris from the working airstream for later disposal, the debris removal assembly having a central axis and comprising:

a debris removal assembly body having an air inlet in fluid communication with the dirt air inlet and an air outlet fluidly upstream of the clean air outlet; and a multi-layer filtration stage having a series of nested components provided within the debris removal assembly body, and comprising a multi-layer filter located radially within a louvered exhaust grill that is located within a mesh screen, the louvered exhaust grill comprising a generally cylindrical body having a plurality of louvers extending longitudinally relative to the central axis between upper and lower ends of the generally cylindrical body and forming air flow openings therebetween, the mesh screen disposed radially outwardly from the plurality of louvers relative to the central axis and about an entire periphery of the louvered exhaust grill and the multi-layer filter mounted within an interior formed by the plurality of louvers, fluidly downstream of the air flow openings, and comprising multiple layers of filtration material.

* * * * *